US011670450B2

(12) United States Patent
Maeta et al.

(10) Patent No.: US 11,670,450 B2
(45) Date of Patent: Jun. 6, 2023

(54) TAPERED FERRITE CORE, ITS PRODUCTION METHOD AND APPARATUS, AND INDUCTANCE DEVICE COMPRISING IT

(71) Applicant: PROTERIAL, LTD., Tokyo (JP)

(72) Inventors: Akihiro Maeta, Tottori (JP); Katsumasa Yamasaki, Tottori (JP)

(73) Assignee: PROTERIAL, LTD., Tokyo (JP)

( * ) Notice: Subject to any disclaimer, the term of this patent is extended or adjusted under 35 U.S.C. 154(b) by 625 days.

(21) Appl. No.: 16/619,810

(22) PCT Filed: Jun. 5, 2018

(86) PCT No.: PCT/JP2018/021531
§ 371 (c)(1),
(2) Date: Dec. 5, 2019

(87) PCT Pub. No.: WO2018/225719
PCT Pub. Date: Dec. 13, 2018

(65) Prior Publication Data

US 2020/0135393 A1 Apr. 30, 2020

(30) Foreign Application Priority Data

Jun. 6, 2017 (JP) ..... JP2017-111413

(51) Int. Cl.
*H01F 27/24* (2006.01)
*H01F 41/02* (2006.01)
(Continued)

(52) U.S. Cl.
CPC ..... *H01F 41/0206* (2013.01); *B24B 5/36* (2013.01); *H01F 1/344* (2013.01); *H01F 27/24* (2013.01); *H01F 27/2823* (2013.01)

(58) Field of Classification Search
CPC ..... H01F 41/0206; H01F 1/344; H01F 27/24; H01F 27/2823; H01F 3/08; H01F 27/255;
(Continued)

(56) References Cited

U.S. PATENT DOCUMENTS 3,207,976 A * 9/1965 Stimler ..... H01F 29/14 323/329
3,246,234 A * 4/1966 Stimler ..... H03F 9/00 336/232
(Continued)

FOREIGN PATENT DOCUMENTS

CN 103332936 A 10/2013
CN 106478085 A 3/2017
(Continued)

OTHER PUBLICATIONS

Office Action dated Jun. 21, 2022 in Japanese Application No. 2019-523905.
(Continued)

*Primary Examiner* — Tuyen T Nguyen
(74) *Attorney, Agent, or Firm* — Sughrue Mion, PLLC

(57) ABSTRACT

A tapered ferrite core having a solid or hollow cylindrical shape with larger length than outer diameter, and comprising a ground taper portion in at least one end portion, the taper portion having ground streaks extending in the longitudinal direction of the ferrite core, can be formed by centerless-grinding a rotating ferrite core by a rotating grinder.

4 Claims, 6 Drawing Sheets

(51) Int. Cl.

| | |
|---|---|
| ***B24B 5/36*** | (2006.01) |
| ***H01F 1/34*** | (2006.01) |
| ***H01F 27/28*** | (2006.01) |

(58) Field of Classification Search
CPC .. H01F 41/02; B24B 5/36; B24B 5/24; B24B 5/313
See application file for complete search history.

(56) References Cited

U.S. PATENT DOCUMENTS

| | | | | |
|---|---|---|---|---|
| 4,893,105 | A * | 1/1990 | Maeda | H01F 38/12 336/107 |
| 5,854,881 | A | 12/1998 | Yoshida et al. | |
| 2002/0080002 | A1 * | 6/2002 | Oldfield | H01F 27/255 336/231 |

FOREIGN PATENT DOCUMENTS

| | | | | |
|---|---|---|---|---|
| EP | 685816 | A2 * | 12/1995 | G06F 3/0412 |
| JP | 58-138010 | A | 8/1983 | |
| JP | 63-50143 | B2 | 10/1988 | |
| JP | 01-106152 | U | 7/1989 | |
| JP | 02-30465 | A | 1/1990 | |
| JP | 7-147211 | A | 6/1995 | |
| JP | 08-50535 | A | 2/1996 | |
| JP | 08-130119 | A | 5/1996 | |
| JP | 2001-212729 | A | 8/2001 | |
| JP | 2003-170339 | A | 6/2003 | |

OTHER PUBLICATIONS

Office Action dated Feb. 4, 2021 in European Application No. 18813371.4.
Office Action dated Dec. 29, 2020 in Chinese Application No. 201880037931.5.
Office Action dated Jul. 6, 2021 issued by the China National Intellectual Property Administration in Chinese Application No. 201880037931.5.
International Search Report of PCT/JP2018/021531 dated Sep. 11, 2018.
Office Action dated Dec. 20, 2022, issued by the Japan Patent Office in Japanese Application No. 2019-523905.

* cited by examiner

TAPERED FERRITE CORE, ITS PRODUCTION METHOD AND APPARATUS, AND INDUCTANCE DEVICE COMPRISING IT

CROSS REFERENCE TO RELATED APPLICATIONS

This application is a National Stage of International Application No. PCT/JP2018/021531 filed Jun. 5, 2018, claiming priority based on Japanese Patent Application No. 2017-111413 filed Jun. 6, 2017.

FIELD OF THE INVENTION

The present invention relates to a solid or hollow cylindrical ferrite core having a taper portion in an end portion, a method and an apparatus for efficiently producing it with high precision, and an inductance device comprising it.

BACKGROUND OF THE INVENTION

Electronic appliances such as smartphones and tablet PCs are provided with position-detecting devices composed of electronic pens for instructing position and sensor boards for detecting the position, as means for enabling users to easily input operation information and word information. For example, in the position-detecting device disclosed in JP H08-050535 A, pulse signals are sent from a coil of an electronic pen to sensor coils disposed in X-Y directions on a sensor board, to generate an electromotive force by electromagnetic induction in the coils, thereby obtaining position information in X-Y coordinates. In the electronic appliance, a sensor board is disposed under a display panel, such that information displayed on the display panel by various pieces of software, etc. is combined with the position information to make information input to the electronic appliance easy.

In an electronic pen used in such position-detecting device, a hollow cylindrical magnetic core is disposed in a hollow portion of a coil, to increase coupling with coils on a sensor board for higher accuracy of position information. FIG. 13 shows the internal structure of the electronic pen disclosed in JP H08-050535 A. In this electronic pen, a casing 501 contains a hollow cylindrical ferrite core 506 around which a coil 509 is wound. The hollow cylindrical ferrite core 506 has a tapered tip portion 507 having a diameter reducing according to the internal structure of the casing 501, a switch rod 502 with a cover 503 having a cap-shaped tip, and a hollow portion 504 in which the switch rod 502 is slidable. A rear end of the ferrite core 506 is fixed to a support 508 in the casing 501. A rear end of the switch rod 502 is connected to an operation switch 505 fixed to the circuit board 511.

A small ferrite core used in an electronic pen as described in JP H08-050535 A has a thin, elongated, hollow, cylindrical shape having, for example, an outer diameter of 5 mm or less, a thickness of 1 mm or less and a length of 10 mm or more, such that it is contained in a thin, elongated casing. In such a small hollow cylindrical ferrite core, it may be considered to form a taper portion by grinding its end portion while being chucked by a hollow cylindrical grinding machine, but it needs a complicated operation of centering a ferrite core fixed to a spindle (rotation axis) of the grinding machine with desired precision, not suitable for working large numbers of ferrite cores. Also, because the ferrite core is easily broken due to brittleness, breakage and cracking likely occur during chucking.

Though even long, small, hollow, cylindrical ferrite cores can be dry-molded, it is difficult to densely charge ferrite granules into a die. Particularly tapered end portions tend to have insufficient molding densities. Defects such as deformation, pores, etc. are generated in portions having low molding densities in the sintering step. It is thus difficult to form long, small, hollow, cylindrical ferrite cores by dry molding, with high precision, near-net shape and efficiency.

SUMMARY OF THE INVENTION

Accordingly, an object of the present invention is to provide a solid or hollow cylindrical ferrite core having a taper portion formed in its end portion with high precision, and a method for efficiently producing such a tapered ferrite core by centerless grinding while suppressing breakage and cracking, and an inductance device comprising such a tapered ferrite core.

Thus, the tapered ferrite core of the present invention having a solid or hollow cylindrical shape with larger length than outer diameter comprises a ground taper portion at least in one end portion;

the taper portion having ground streaks extending in the longitudinal direction of the ferrite core.

The tapered ferrite core of the present invention is preferably substantially free from defects due to granule boundaries.

The tapered ferrite core of the present invention is preferably substantially as-sintered in surface portions excluding the taper portion.

The taper portion is preferably constituted by pluralities of worked surfaces having different tapering ratios.

The tapered ferrite core of the present invention may have taper portions at both ends.

The method of the present invention for producing the above tapered ferrite core comprises centerless-grinding at least one end portion of a solid or hollow cylindrical ferrite core by a rotating grinder while rotating the ferrite core around its center axis as a rotation axis, to form a taper portion having ground streaks extending in the longitudinal direction of the ferrite core.

The solid or hollow cylindrical ferrite core is preferably produced by sintering a solid or hollow cylindrical ferrite green body free from granule boundaries.

The method of the present invention for producing a tapered ferrite core preferably comprises using a centerless grinding apparatus comprising a rotatable work-indexing wheel having a circular outer peripheral surface, and a work-pushing member opposing the circular outer peripheral surface of the work-indexing wheel;

rotatably supporting the ferrite core between the rotating work-indexing wheel and the work-pushing member; and rotating the ferrite core around its center axis by rotation speed difference between the work-indexing wheel and the work-pushing member.

It is preferable that in the method of the present invention for producing a tapered ferrite core, the grinder has a circular outer peripheral surface concaved in an axial center portion;

the rotation axis of the grinder and the rotation axis of the work-indexing wheel are substantially perpendicular to each other;

each ferrite core rotating around its center axis moves along a circular outer peripheral surface of the work-indexing wheel; and each ferrite core rotating around its center axis is centerless-ground by sliding contact with the concaved circular outer peripheral surface of the grinder, to form the taper portion.

It is preferable that in the method of the present invention for producing a tapered ferrite core, an annular carrier guide having pluralities of axial slits is arranged around the work-indexing wheel; and each ferrite core is received in each groove constituted by each slit of the carrier guide and the outer peripheral surface of the work-indexing wheel.

It is preferable that in the method of the present invention for producing a tapered ferrite core, the work-indexing wheel has pluralities of axial grooves on the outer peripheral surface; and each ferrite core is received in each groove.

The work-pushing member is preferably (a) a fixed member having a circular inner surface concentric with the circular outer peripheral surface of the work-indexing wheel, or (b) an annular belt rotating around the work-indexing wheel.

The fixed member preferably comprises a wear-resistant layer whose inner surface comes into contact with the ferrite core.

The wear-resistant layer is preferably made of cemented carbide.

It is preferable that in the method of the present invention for producing a tapered ferrite core, the groove is provided at its longitudinal rear end with a work stopper for limiting the longitudinal movement of the ferrite core; and the work stopper acts as a longitudinal reference surface for centerless grinding.

In the method of the present invention for producing a tapered ferrite core, the grinder preferably rotates in a direction pushing the ferrite core toward the work stopper in centerless grinding.

In the method of the present invention for producing a tapered ferrite core, the groove is preferably inclined by a predetermined angle relative to the direction of the rotation axis of the work-indexing wheel, thereby pushing the ferrite core in the groove to the work stopper.

In the method of the present invention for producing a tapered ferrite core, the solid or hollow cylindrical ferrite green body free from granule boundaries is preferably formed by extrusion molding.

The first apparatus of the present invention for producing the above tapered ferrite core comprises a rotatable work-indexing wheel having a circular outer peripheral surface;

a work-pushing member opposing the circular outer peripheral surface of the work-indexing wheel;

a rotatable, cylindrical carrier guide having pluralities of slits extending in the direction of the rotation axis of the work-indexing wheel, and arranged around the work-indexing wheel; and a grinder having a circular outer peripheral surface and rotating substantially in the longitudinal direction of the slit;

a solid or hollow cylindrical ferrite core being received in each groove constituted by the circular outer peripheral surface of the work-indexing wheel and each slit of the cylindrical carrier guide;

each ferrite core rotating around its center axis by rotation speed difference between the work-indexing wheel and the work-pushing member, and revolving along the work-indexing wheel by the rotation of the cylindrical carrier guide, so that each ferrite core moves to a position at which it comes into sliding contact with the grinder; and at least one end portion of each ferrite core rotating around its center axis being centerless-ground by the grinder, to form a taper portion having ground streaks extending in the longitudinal direction of the ferrite core.

In the above first apparatus, the work-pushing member is preferably a fixed member having a wear-resistant layer whose inner surface comes into contact with the ferrite core.

The second apparatus of the present invention for producing the above tapered ferrite core comprises a rotatable work-indexing wheel having pluralities of axial grooves on the circular outer peripheral surface;

a work-pushing member opposing the circular outer peripheral surface of the work-indexing wheel; and a grinder having a circular outer peripheral surface and rotating substantially in the longitudinal direction of the groove of the work-indexing wheel;

a solid or hollow cylindrical ferrite core being received in each groove of the work-indexing wheel;

each ferrite core rotating around its center axis by rotation speed difference between the work-indexing wheel and the work-pushing member, and revolving by the rotation of the work-indexing wheel, so that each ferrite core moves to a position at which it comes into sliding contact with the grinder; and at least one end portion of each ferrite core rotating around its center axis being centerless-ground by the grinder, to form a taper portion having ground streaks extending in the longitudinal direction of the ferrite core.

In the above second apparatus, the work-pushing member is preferably an annular belt rotating around the work-indexing wheel.

The inductance device of the present invention comprises a conductor wire wound around the above tapered ferrite core.

Effects of the Invention

According to the present invention, a solid or hollow cylindrical ferrite core having a taper portion having longitudinal ground streaks in at least one end portion can be produced with high efficiency while suppressing breakage and cracking, because at least one end portion of the ferrite core is centerless-ground by a rotating grinder.

BRIEF DESCRIPTION OF DRAWINGS

FIG. 10(*b*) is a longitudinal cross-sectional view showing a tapered ferrite core according to an embodiment of the present invention.

DESCRIPTION OF THE PREFERRED EMBODIMENTS

The embodiments of the present invention will be explained in detail below referring to the attached drawings, without intention of restricting the present invention thereto. The present invention may be properly modified within the scope of its technical idea. In the attached drawings, only important portions are shown for easiness of understanding the present invention, with their details omitted.

[1] Production Method of Ferrite Core

Figure 1:
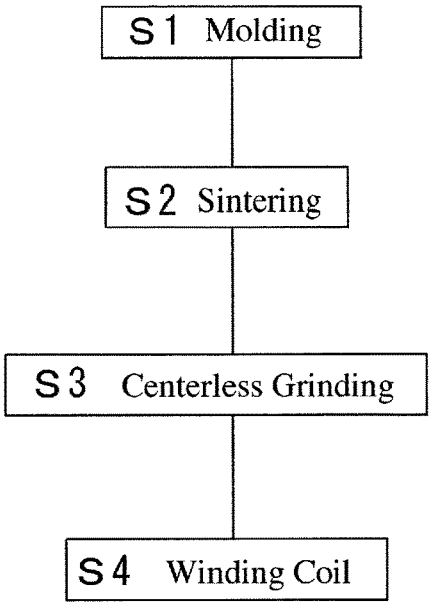
FIG. 1 is a flow chart showing the production steps of an inductance device according to an embodiment of the present invention.

FIG. 1 is a flow chart showing an example of methods for producing the tapered ferrite core of the present invention. This method comprises a molding step S1 for forming soft ferrite powder into a ferrite green body free from granule boundaries, a step S2 for sintering the ferrite green body under predetermined temperature and conditions to form a solid or hollow cylindrical ferrite core having a substantially as-sintered surface, and a step S3 for centerless-grinding an end portion of the ferrite core to a taper shape. A coil can be wound around the ferrite core having a taper portion to provide an inductance device (coil-winding step S4).

The ferrite green body free from granule boundaries is a ferrite green body obtained by molding soft ferrite powder without granulation. The methods for forming a ferrite green body free from granule boundaries include (1) a method of adding a water-soluble binder such as methyl cellulose, etc. to soft ferrite powder, blending the resultant mixture by a high-shear blender such as a Banbury mixer, a mixing roll, etc. to form a clay-like, moldable material, and extrusion-molding it; (2) a method of mixing soft ferrite powder with a thermoplastic resin or wax as a binder, heating the resultant slurry, and injection-molding it, etc. Particularly to obtain a long, solid or hollow cylindrical ferrite green body free from granule boundaries, extrusion molding is suitable from the aspect of productivity.

Figure 14:
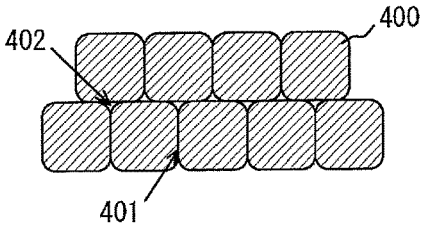
FIG. 14 is a schematic view showing boundaries of granules in the ferrite green body.

Before explaining methods for forming a ferrite green body free from granule boundaries, a dry-molding method using ferrite granules will be explained. Dry molding is a method of granulating ferrite powder to granules having proper sizes for molding, and compressing ferrite granules charged into a die cavity having a predetermined shape to form a ferrite green body having a predetermined shape. A surface of a ferrite green body obtained by dry molding is schematically shown in FIG. 14. Because the ferrite green body is constituted by relatively large granules 400, large pores 402 are likely to remain in boundaries (granule boundaries) 401 of granules 400. Pores 402 in the granule boundaries are likely to remain as defects (defects due to granule boundaries) in a ferrite core obtained by sintering such green body.

Figure 2:
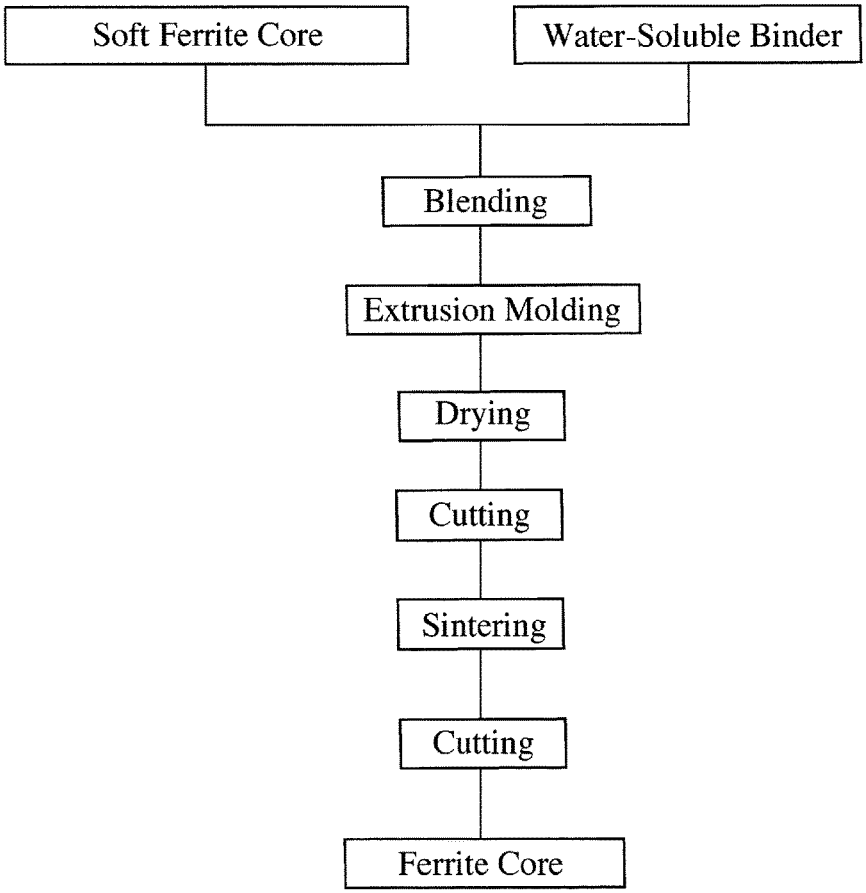
FIG. 2 is a flow chart showing an example of the production methods of a ferrite core.

On the other hand, extrusion molding or injection molding, which does not use granules, provides a ferrite green body with no granule boundaries. Accordingly, the sintered ferrite core has high mechanical strength without defects due to granule boundaries. As an example of the molding steps S1, the extrusion molding method shown in FIG. 2 will be explained in detail below.

(1) Preparation of Moldable Material

Used in the extrusion molding is a clay-like, moldable material comprising a predetermined percentage of a binder added to soft ferrite powder. Considering the magnetic characteristics of a ferrite core depending on its applications, the soft ferrite powder may be selected from general Mn ferrite, Ni ferrite, etc. The soft ferrite powder can be obtained, for example, by wet-mixing oxides of Fe, Zn, Cu, Ni, etc. at predetermined proportions, drying the resultant mixture, calcining it at 750-1000° C. to form a substantially entirely spinelized calcined body, disintegrating it by a pulverizer, introducing the calcined body together with ion-exchanged water into a ball mill, etc. to pulverize it to predetermined particle sizes, and drying the resultant soft ferrite powder slurry. Though the drying of the slurry by a spray drier after a binder such as polyvinyl alcohol (PVA), etc. is added provides soft ferrite powder granules, agglomerated soft ferrite powder can be disintegrated by blending (described later) to obtain a ferrite green body free from granule boundaries. In this case, the binder is preferably removed before blending.

Soft ferrite powder having smaller particle sizes has higher reactivity to each other, resulting in accelerated sintering densification from a low sintering temperature, so that a dense ferrite core having small and uniform crystal grain sizes can be obtained even at a sintering temperature of 1000° C. or lower. The low-temperature sintering can shorten the sintering time and reduce energy consumption. On the other hand, soft ferrite powder having smaller particle sizes has a larger specific surface area, so that a larger amount of a binder is needed for molding. In view of the above, the average particle size of the pulverized soft ferrite powder measured by an air permeability method is preferably 0.8-5 μm, more preferably 1-3 μm.

The preferable binders are water-soluble binders such as cellulose resins (methylcellulose, hydroxypropyl methylcellulose, hydroxyethyl methylcellulose, etc.), water-soluble acrylic resins, etc. The soft ferrite powder is mixed with an aqueous solution of a binder in pure water containing, if necessary, a dispersant, a lubricant, etc., and blended to form a material for extrusion molding (moldable material). If the amount of the binder is too small, blending cannot provide a uniform moldable material, and an extruded green body undergoes an excessive load and does not have desired strength. A larger amount of the binder results in a lower green body density, leading to increased sintering shrinkage and more deformation of the ferrite core. The amount of the binder added is preferably 3-10 parts by mass per 100 parts by mass of the soft ferrite powder. The amount of pure water added is preferably 10-20 parts by mass per 100 parts by mass of the soft ferrite powder, though variable depending on the kind and amount of the binder, and the desired hardness of the moldable material.

Blending can be conducted by a blending apparatus such as a Banbury mixer, a super mixer, a Henschel mixer, a three-roll mixer, a compression kneader, etc. Blending is conducted preferably in a cooled state, to suppress the evaporation of water. In the case of a cellulose binder, the blending temperature of the moldable material is preferably lower than 40° C., more preferably 10° C. or lower, to prevent gelation during blending which starts at about 40-50° C. On the other hand, too low a blending temperature generates dew, which is added to the moldable material to have an uneven water content, or leaves the moldable material too hard for blending. To prevent this, the blending temperature of the moldable material is preferably 5° C. or higher. To adjust the temperature of the moldable material, temperature-adjusted cooling water is preferably circulated through the blending apparatus itself, or through a water path in a water jacket covering the blending apparatus.

(2) Extrusion

The blended moldable material is molded to a hollow or solid cylindrical shape by an extruder having a cooling mechanism. Cooling is conducted to suppress the heat generation of the moldable material as in blending. Extrusion may be conducted by using a plunger, but the use of a screw is preferable to add further blending to the moldable material. A ferrite green body extruded from a die of the extrusion-molding machine is free from granule boundaries. The ferrite green body is quickly and continuously sent by a conveyer to a drying step.

(3) Drying

The ferrite green body is continuously dried at a temperature of the gelation temperature of the binder in the green body or higher and lower than its thermal decomposition temperature, by a belt drier, etc. The drying temperature is preferably 50-200° C. Though variable depending on the size of the green body, the drying time is preferably 2-10 minutes for a size of 5 mm or less.

(4) Preliminary Cutting

The hollow or solid cylindrical ferrite green body having mechanical strength increased by drying solidification is preliminarily cut to a desired length. A rotating grinder is preferably used for cutting, but blade may be used. Because the dried ferrite green body has higher deformation resistance than before drying, deformation such as dent and elongation by cutting can be suppressed.

(5) Sintering

The cut ferrite green body is degreased to remove the binder, and sintered to form a sintered body. A sintering ceramic jig (setter), on which ferrite green bodies are arranged, preferably has dents for preventing the rolling of the ferrite green bodies. In the sintering step, a continuous sintering furnace such as a roller hearth kiln, etc., and a batch-type sintering furnace may be used. The sintering is preferably conducted at 900-1300° C. for 4-24 hours, though variable depending on the composition and particle size of soft ferrite powder.

(6) Final Cutting

Both ends of the resultant sintered body are cut by a cutter to form a hollow or solid cylindrical ferrite core having a predetermined length. It is preferable to use a rotating grinder to cut end portions of the ferrite core perpendicularly to its center axis. The resultant ferrite core is free from pores due to granule boundaries, etc., with less deformation and excellent dimension precision.

(7) Centerless Grinding

The centerless grinding of end portions of the hollow or solid cylindrical ferrite core provides a ferrite core having a high-precision taper portion.

Figure 3:
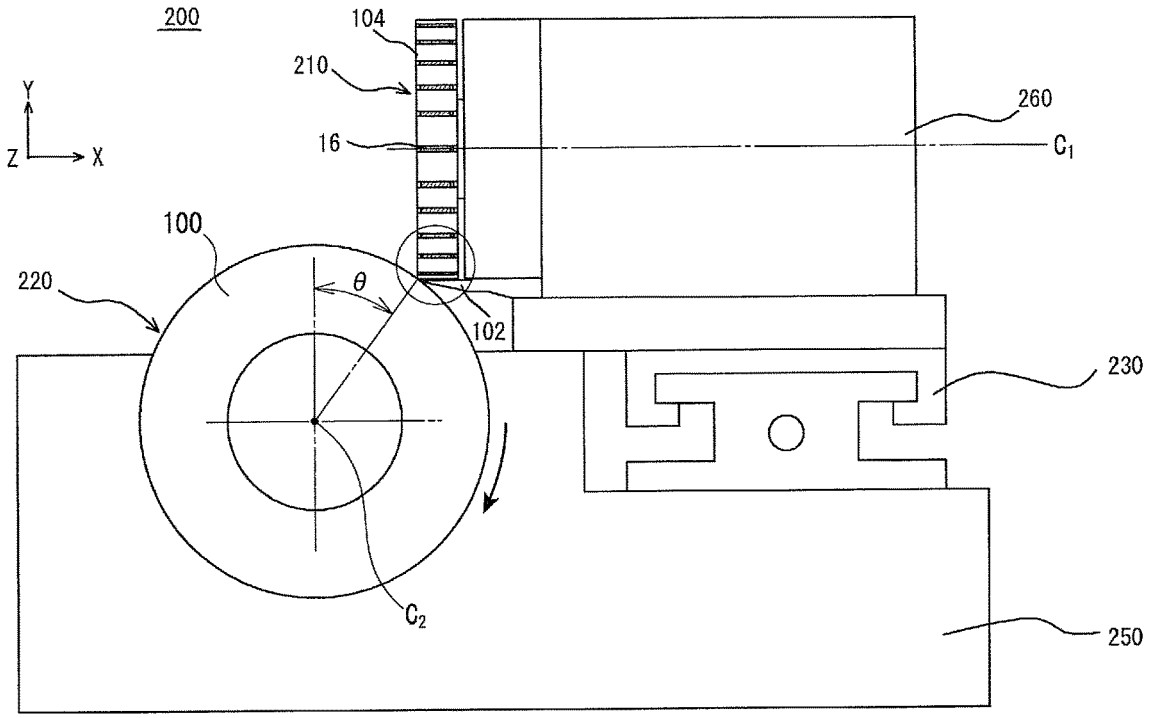
FIG. 3 is a schematic view showing an example of centerless grinding apparatuses used for producing the tapered ferrite core of the present invention.
Figure 4:
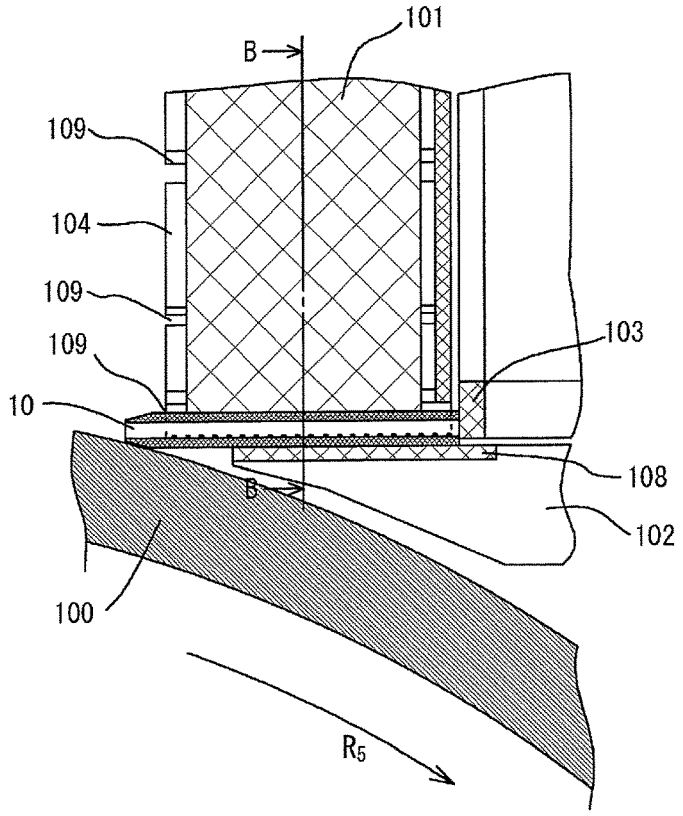
FIG. 4 is an enlarged cross-sectional view showing an important portion of the centerless grinding apparatus of FIG. 3.

FIG. 3 shows an example of centerless grinding apparatuses used for producing the ferrite core of the present invention, and FIG. 4 shows its important portion. As shown in FIG. 3, the centerless grinding apparatus 200 comprises as main parts a work-indexing mechanism 210 mounted onto a base 250 and a work-grinding member 220. The work-indexing mechanism 210 comprises a cylindrical carrier guide 104, a disc-shaped work-indexing wheel 101 having a circular outer peripheral surface, which is arranged inside the carrier guide 104, and a work-pushing member 102 for supporting a work (ferrite core) 10, which is opposing the work-indexing wheel 101. The work-indexing wheel 101 is arranged with its rotation axis $C_1$ aligned in the X direction in FIG. 3, and connected to a driving means 260 including a servomotor, etc. The work-grinding member 220, which is arranged with its rotation axis $C_2$ aligned in the Z direction in FIG. 3, comprises a grinder 100 connected to a driving means (not shown) such as a servomotor, etc.

The work-indexing mechanism 210 is mounted to the base 250 via a movable bed 230 comprising pluralities of sliding members, such that it is slidable in an X-Z plane in FIG. 3 to enable its positional adjustment relative to the grinder 100.

The rotation axis $C_2$ of the grinder 100 is positioned under the rotation axis $C_1$ of the disc-shaped work-indexing wheel 101 for rotating ferrite cores 10. The grinder 100 preferably comprises, for example, abrasive diamond particles, abrasive CBN (cubic boron nitride) particles, etc. fixed by a binder such as a metal bond, etc. In the depicted example, the rotation axis $C_2$ of the grinder 100 is perpendicular to the rotation axis $C_1$ of the work-indexing wheel 101. The term "perpendicular" is not restricted to geometrically strict perpendicular, but permits the inclination of about 2-3°.

Figure 5:
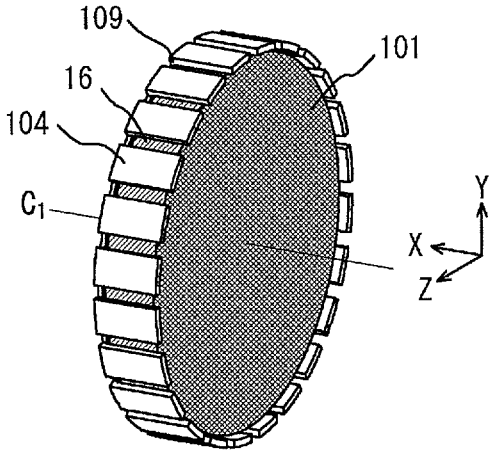
FIG. 5 is a perspective view showing a work-indexing wheel and a carrier guide in the centerless grinding apparatus of FIG. 3.

Arranged around the work-indexing wheel 101 is a cylindrical carrier guide 104 having longitudinally aligned comb-like slits 109 open toward the grinder 100 at predetermined pitches. FIG. 5 shows a combination of the carrier guide 104 and the work-indexing wheel 101. Each slit 109 and the circular outer peripheral surface of the work-indexing wheel 101 constitutes each groove 16 receiving each ferrite core 10. In the depicted example (FIG. 6), the carrier guide 104 rotates in the same direction $R_2$ as the rotation direction $R_1$ of the work-indexing wheel 101.

Arranged under the work-indexing wheel 101 is a work-pushing member 102 opposing the circular outer peripheral surface of the work-indexing wheel 101. In the depicted example, the work-pushing member 102 is fixed, and has a circular inner surface concentric with the circular outer peripheral surface of the work-indexing wheel 101. The gap between the work-indexing wheel 101 and the work-pushing member 102 is substantially equal to the outer diameter of a ferrite core 10 received in each groove 16 of the work-indexing mechanism 210.

The work-pushing member 102 preferably has a wear-resistant layer 108 made of cemented carbide having excellent rigidity and wear resistance, etc. on the side of contacting with a ferrite core. A circular outer peripheral surface of the work-indexing wheel 101 coming into contact with a ferrite core 10 is preferably made of an elastic material such as urethane rubber having proper elasticity and friction resistance, etc.

The grinder 100 is rotated substantially in the longitudinal direction of the ferrite core 10, such that the outer peripheral surface of the grinder 100 moves along a taper portion **13*a* formed in an end portion of the ferrite core 10. Because the grinder 100 is rotated in the arrow direction $R_5$ (direction toward a rear end of the ferrite core 10) shown in FIG. 4, the ferrite core 10 is pushed toward a rear end of the work-indexing wheel 101 (opposite side of an open end of the slit 109) by the grinding force of the grinder 100. Accordingly, a longitudinal rear end of the slit 109 is provided with a work stopper 103 abutting the rear end surface (end surface not subjected to centerless grinding) of the ferrite core 10. Because the work stopper 103 is always pushed by the ferrite core 10 during centerless grinding, the ferrite core 10** is precisely longitudinally positioned during centerless grinding.

Figure 6:
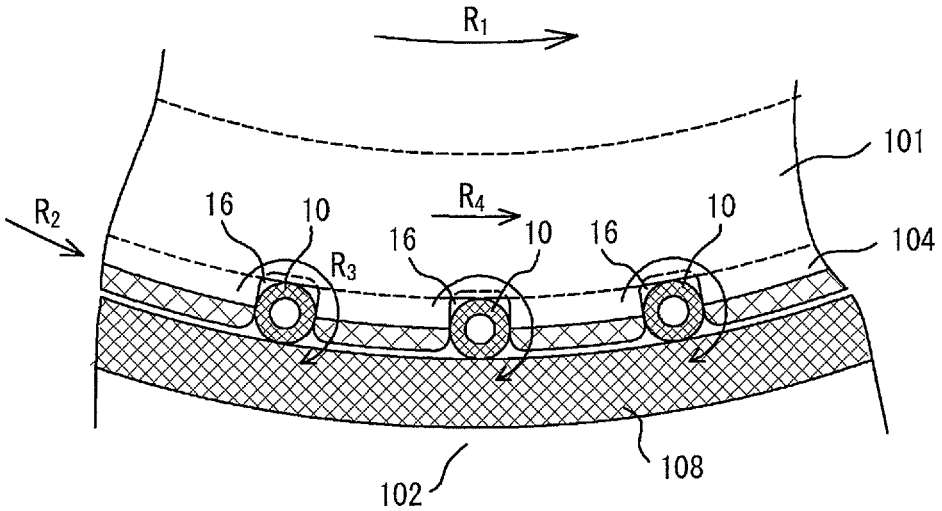
FIG. 6 is a cross-sectional view taken along the line B-B in FIG. 4.

A ferrite core 10 supplied one by one from a supply apparatus (not shown) to the groove 16 passes through a gap between the circular outer peripheral surface of the work-indexing wheel 101 and the circular inner surface of the work-pushing member 102 opposing each other, while being gripped by them, as shown in FIG. 6. Because the ferrite core 10 is pushed toward the work-pushing member 102 by the work-indexing wheel 101, the rotation of the work-indexing wheel 101 is transmitted to the ferrite core 10, so that the ferrite core 10 rotates around its center axis in a direction $R_3$ opposite to the rotation direction $R_1$ of the work-indexing wheel 101.

The rotation speed of the ferrite core 10 around its center axis is generally determined by the rotation speed difference between the work-indexing wheel 101 and the work-pushing member 102. To rotate the ferrite core 10 at a desired speed, the rotation speed $V_1$ of the work-indexing wheel 101 and the rotation speed $V_2$ of the work-pushing member 102 are properly set. Because the rotation speed $V_2$ of the work-pushing member 102 is zero in the depicted example, the rotation speed $V_1$ of the work-indexing wheel 101 per se corresponds to the "rotation speed difference." However, with the work-pushing member 102 rotating as described later, the "rotation speed difference" is the difference of their rotation speeds $V_1$ and $V_2$ when the work-indexing wheel 101 and the work-pushing member 102 rotate in the same direction, and the sum of their rotation speeds $V_1$ and $V_2$ when they rotate in opposite directions.

The ferrite core 10 rotating around its center axis while being pushed by the work-indexing wheel 101 to the work-pushing member 102 moves at a speed corresponding to the rotation speed between the circular outer peripheral surface of the work-indexing wheel 101 and the work-pushing member 102. This movement is hereinafter called "revolution." However, a sufficient rotation speed $V_4$ leads to too high a revolution speed $V_5$, resulting in too short a sliding contact time of the ferrite core 10 with the grinder 100. To secure a sufficient sliding contact time of the ferrite core 10 with the grinder 100, the rotation speed $V_3$ of the carrier guide 104 is preferably sufficiently lower than the rotation speed $V_1$ of the work-indexing wheel 101. A ratio of the rotation speed $V_3$ of the carrier guide 104 to the rotation speed $V_1$ of the work-indexing wheel 101 is preferably 0.4-0.7.

The ferrite core 10 received in the groove 16 with its tip portion projecting from the open end of the groove 16 and its rear end surface in contact with the work stopper 103 rotates around its center axis in the groove 16 at a speed $V_4$ determined by the rotation speed $V_1$ of the work-indexing wheel 101, while revolving at the same speed $V_5$ as the rotation speed $V_3$ of the carrier guide 104 in an annular space between the work-indexing wheel 101 and the work-pushing member 102, so that the tip portion of the ferrite core 10 comes into sliding contact with the outer peripheral surface of the grinder 100 for a sufficient period of time as shown in FIG. 4.

Figure 7:
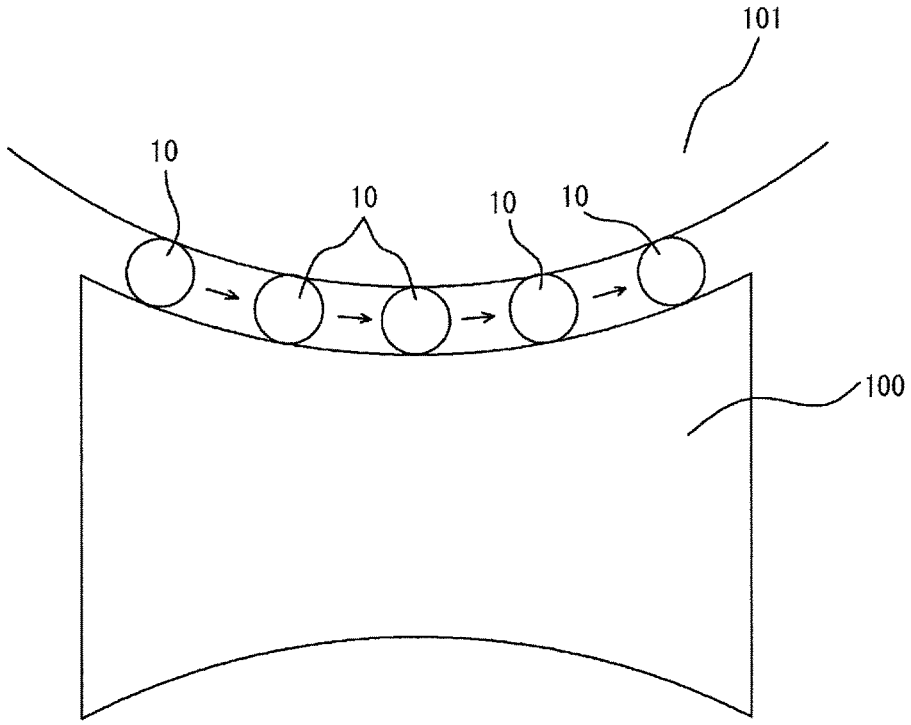
FIG. 7 is a schematic view showing ferrite cores moving along a concaved circular outer peripheral surface of a grinder, in the centerless grinding method of the ferrite core according to an embodiment of the present invention.

As shown in FIG. 7, the outer peripheral surface of the grinder 100 is preferably in a circular shape whose axial center portion is concaved concentrically with the work-indexing wheel 101. While the ferrite core 10 is ground during revolution around the work-indexing wheel 101, the tip portion of the ferrite core 10 projecting from the groove 16 is ground by substantially uniform sliding contact with the grinder 100, resulting in the formation of the taper portion 13.

Figure 11:
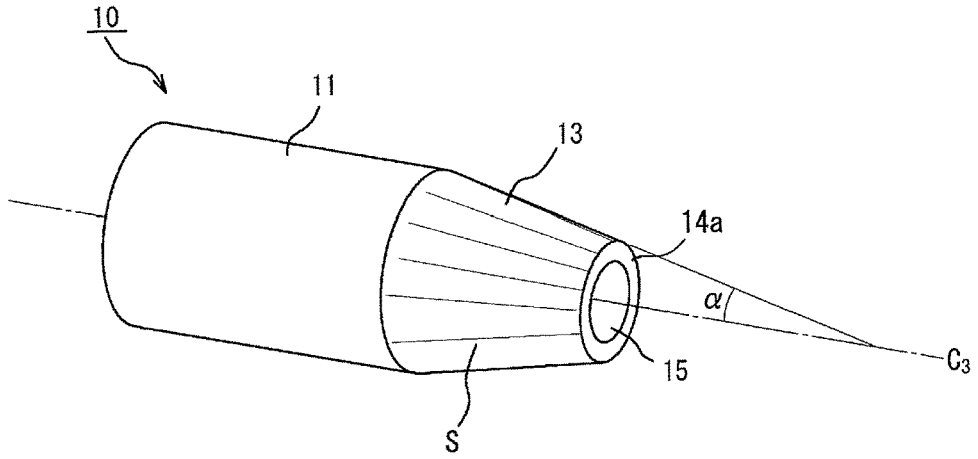
FIG. 11 is a partial, enlarged perspective view showing a taper portion of the tapered ferrite core of FIGS. 10(*a*) and 10(*b*).

Because the grinder 100 has a sufficiently larger diameter than the outer diameter of the ferrite core 10, the inclination angle $\alpha$ of the taper portion 13 (angle between the worked surface of the taper portion 13 and the center axis $C_3$ of the ferrite core 10 in FIG. 11) is substantially equal to an angle $\theta$ between a line extending perpendicularly (in a Y direction) from a center point on the center axis $C_2$ of the grinder 100, and a line connecting a contact point of the ferrite core 10 with the outer peripheral surface of the grinder 100 and the above center point.

Figure 8:
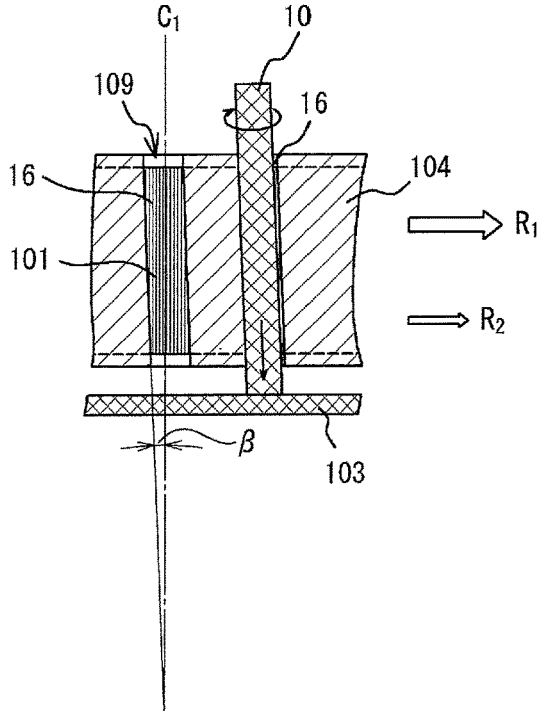
FIG. 8 is a partial bottom view showing the inclination of grooves in the centerless grinding apparatus of FIG. 3.

As shown in FIG. 8, the groove 16 of the work-indexing mechanism 210 is desirably inclined from the rotation axis $C_1$ of the work-indexing wheel 101 by a predetermined angle $\beta$. The work-indexing wheel 101 and the carrier guide 104 rotate in the same direction (rightward in FIG. 8) with a predetermined rotation speed difference ($V_1$-$V_3$). The grinder 100 is positioned on the front side in FIG. 8. For example when the groove 16 is inclined with its portion on the side of the grinder 100 lagging in the rotation direction, the outer peripheral surface of the ferrite core 10 comes into contact with a side surface (left side in FIG. 8) of the slit 109 of the carrier guide 104 due to the rotation speed difference ($V_1$-$V_3$) between the work-indexing wheel 101 and the carrier guide 104. When the tip portion of the ferrite core 10 is centerless-ground by the grinder 100 in this state, a rear end surface of the ferrite core 10 is likely pushed to the work stopper 103 (lower side in FIG. 8) by a reaction force from the side surface of the slit 109. As a result, the position of the ferrite core 10 is longitudinally precisely set by the work stopper 103. To prevent the breakage and cracking of an end edge of the ferrite core 10 in contact with the work stopper 103, the inclination angle $\beta$ of the groove 16 is desirably set to 3° or less to reduce a force component applied to the work stopper 103.

Figure 9:
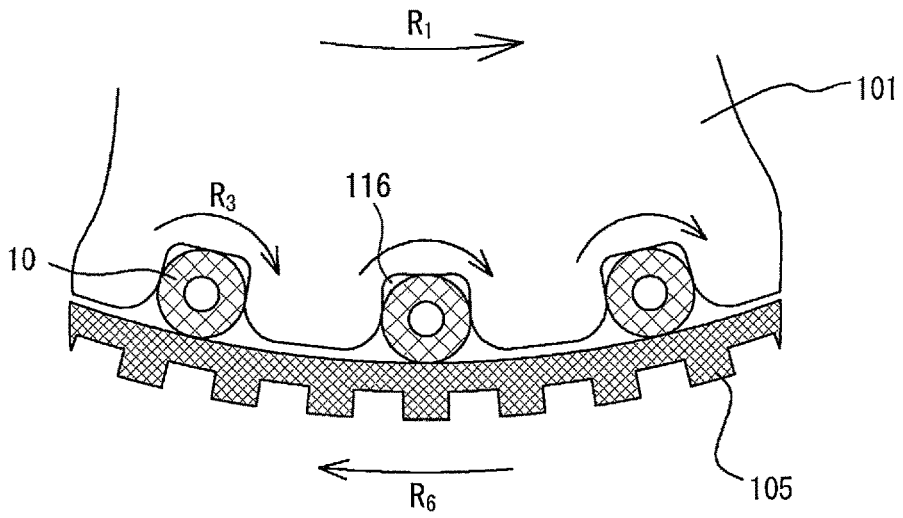
FIG. 9 is a cross-sectional view showing the centerless grinding method of a ferrite core according to another embodiment of the present invention.

FIG. 9 shows another centerless grinding apparatus used in the present invention. This centerless grinding apparatus comprises a rotatable work-indexing wheel 101 having pluralities of axial grooves 116 on a circular outer peripheral surface, in place of the rotatable, flat work-indexing wheel having a circular outer peripheral surface, which is shown in FIGS. 3-5; and a belt 105 moving along the outer peripheral surface of the work-indexing wheel 101 in an opposite direction $R_6$, in place of the fixed work-pushing member shown in FIGS. 3 and 4. A grinder 100 having a circular outer peripheral surface rotates substantially in the longitudinal direction of the groove 116 of the work-indexing wheel 101, such that the outer peripheral surface of the grinder 100 moves along a taper portion 13 formed in an end portion of the ferrite core 10.

A ferrite core 10 received in each groove 116 on the outer peripheral surface of the work-indexing wheel 101 rotates around its center axis by opposite rotation directions between the work-indexing wheel 101 and the belt 105. In this centerless grinding apparatus, too, the end portion of the ferrite core 10 is brought into contact with the grinder 100 to form a taper portion 13, thereby producing a ferrite core having a high-precision taper portion. Incidentally, for the revolution of the ferrite core 10, the same carrier guide and work-indexing wheel as in the centerless grinding apparatus shown in FIGS. 3 and 4 may be used.

[2] Tapered Ferrite Core

Figure 10A:
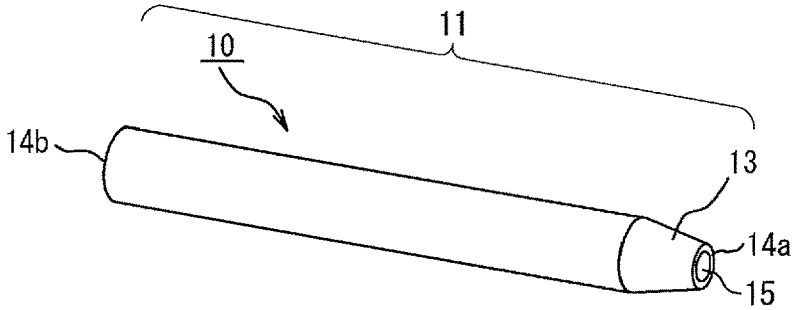
FIG. 10(*a*) is a perspective view showing a tapered ferrite core according to an embodiment of the present invention.
Figure 10B:
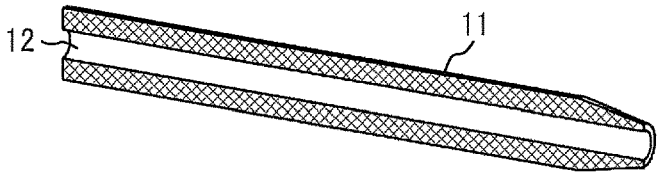

FIG. 10(*a*) shows the appearance of a hollow cylindrical ferrite core whose end portion is centerless-ground, FIG. 10(*b*) shows its longitudinal cross section, and FIG. 11 shows a taper portion of the ferrite core. The ferrite core 10 has an outer peripheral surface 11, an inner surface 12, both end surfaces 14*a*, 14*b* cut perpendicularly to the center axis $C_3$, a taper portion 13 formed on the side of an end surface 14*a*, and an opening 15 communicating with the inner surface 12. The outer peripheral surface 11 except for the taper portion 13 and the inner surface 12 are in an as-sintered state ("as-sintered surface"). The depicted ferrite core 10 is as long as about 6 times the outer diameter of the outer peripheral surface 11.

Ground streaks (tool marks or wheel marks) remain on the centerless-ground surface of the taper portion 13. Because the rotation speed of the grinder 100 is sufficiently larger than the rotation speed of the ferrite core 10 around its center axis, ground streaks on the worked surface of the taper portion 13 extend substantially linearly in the longitudinal direction of the hollow cylindrical ferrite core 10. Such ground streaks radially isotropically extending from the center axis $C_3$ of the ferrite core 10 can make up for the reduced mechanical strength of the taper portion 13 of the ferrite core 10, securing cracking resistance, breakage resistance, impact resistance, etc.

Figure 12:
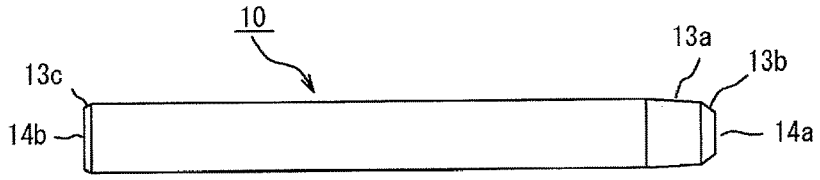
FIG. 12 is a side view showing a tapered ferrite core according to a further embodiment of the present invention.
Figure 13:
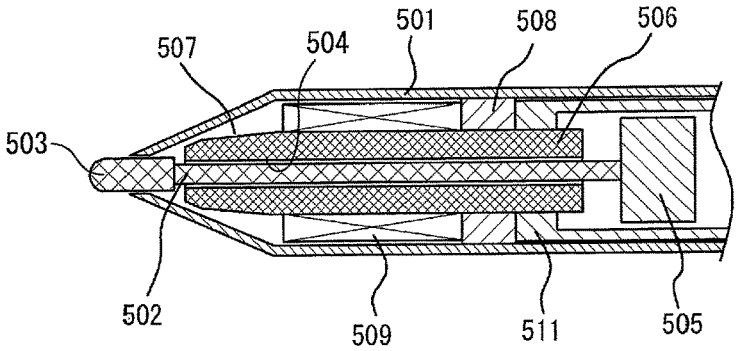
FIG. 13 is a cross-sectional view showing an example of electronic pens using the tapered ferrite core.

FIG. 12 shows another example of the tapered ferrite cores. This tapered ferrite core 10 has chamfered portions 13*b*, 13*c* formed on the tip taper portion 13 and the rear end surface 14*b*. The chamfered portions 13*b*, 13*c* can be formed by centerless grinding using the apparatus of the present invention, like the taper portion 13. Of course, the inclination angle θ of the ferrite core 10 to the outer peripheral surface of the grinder 100 is properly changed to faun the chamfered portions 13*b*, 13*c*.

When a ferrite core having excellent roundness, concentricity, cylindricity and straightness without pores due to granule boundaries is subjected to centerless grinding, the taper portion 13 can be formed with high precision, with less breakage and cracking even if the ferrite core is as small as 3 mm or less in outer diameter or as thin as 0.5 mm or less. Because the taper portion 13 is formed by centerless grinding, there are no needs of chucking the ferrite core 10 and centering the ferrite core 10 for fixing, resulting in high productivity.

[3] Inductance Device

A coil is wound around the ferrite core in the coil-winding step S4, to obtain an inductance device. Though not restrictive, a wound conductor wire may be, for example, a stranded wire such as an enameled wire (copper wire coated with polyamideimide), a Litz wire, etc., to increase the Q factor of the inductance device at high frequencies. The number of winding a conductor wire can be properly set depending on the inductance required, and the diameter of the conductor wire can be properly set depending on current. Though a coil may be wound around the ferrite core directly, it is preferable to use a bobbin made of resins such as polyphenylene sulfide, liquid polymers, polyethylene terephthalate, polybutylene terephthalate, etc., when the specific resistance of the ferrite core is as low as, for example, less than $10^3$ Ω·m. Inductance devices using the ferrite core of the present invention can be used for electronic pens, LF antennas, choke coils, etc.

In the present invention, a taper portion is highly efficiently formed by centerless grinding in an end portion of a solid or hollow cylindrical ferrite core, with suppressed breakage and cracking, and with no likelihood of human error without needing a special skill.

DESCRIPTION OF REFERENCE NUMERALS

10: Ferrite core
11: Outer peripheral surface of ferrite core
12: Inner surface of ferrite core
13*a*: Taper portion of ferrite core
13*b*, 13*c*: Chamfered portion of ferrite core
14*a*, 14*b*: End surface of ferrite core
15: Opening communicating with inner surface
16, 116: Groove
101: Work-indexing wheel
102: Work-pushing member
103: Work stopper
104: Carrier guide
105: Belt
108: Wear-resistant layer
109: Slit
200: Centerless grinding apparatus
210: Work-indexing mechanism
220: Work-grinding member
230: Movable bed
250: Base
260: Driving means
S: Ground streaks
$C_1$: Rotation axis of work-indexing wheel
$C_2$: Rotation axis of grinder
$R_1$: Rotation direction of work-indexing wheel
$R_2$: Rotation direction of carrier guide
$R_3$: Rotation direction of ferrite core around its center axis
$R_4$: Revolution direction of ferrite core
$V_1$: Rotation speed of work-indexing wheel
$V_2$: Rotation speed of work-pushing member
$V_3$: Rotation speed of carrier guide
$V_4$: Rotation speed of ferrite core around its center axis
$V_5$: Revolution speed of ferrite core

What is claimed is:

1. A tapered ferrite core having a solid or hollow cylindrical shape with larger length than outer diameter;

said ferrite core having a ground taper portion in at least one end portion; and said taper portion having ground streaks extending in the longitudinal direction of the ferrite core.

2. The tapered ferrite core according to claim 1, wherein said ferrite core has no defects due to granule boundaries.

3. The tapered ferrite core according to claim 1, wherein said taper portion is constituted by pluralities of worked surfaces having different tapering ratios.

4. A tapered ferrite core having a solid or hollow cylindrical shape with larger length than outer diameter;

said ferrite core having a ground taper portion in at least one end portion; and said taper portion having ground streaks extending in the longitudinal direction of the ferrite core and radially isotropically extending from a center axis of the ferrite core.

* * * * *